US006622632B1

(12) United States Patent
Spivak

(10) Patent No.: US 6,622,632 B1
(45) Date of Patent: Sep. 23, 2003

(54) POLAR EJECTION ANGLE CONTROL FOR FRAGMENTING WARHEADS

(75) Inventor: Timothy L. Spivak, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/087,895

(22) Filed: Mar. 1, 2002

(51) Int. Cl.[7] ..... F42B 13/18

(52) U.S. Cl. ..... 102/475; 102/305; 102/492; 102/499

(58) Field of Search ..... 102/305, 475, 102/492, 499

(56) References Cited

U.S. PATENT DOCUMENTS 3,326,125 A * 6/1967 Silvia et al. ..... 102/475
3,447,463 A * 6/1969 Lavine ..... 102/475
3,648,610 A * 3/1972 van Zyl et al. ..... 102/475
4,282,814 A * 8/1981 Menz et al. ..... 102/499
4,658,727 A * 4/1987 Wilhelm et al. ..... 102/494
4,848,239 A * 7/1989 Wilhelm ..... 102/492
5,267,513 A * 12/1993 Guirguis et al. ..... 102/475

* cited by examiner

*Primary Examiner*—Harold J. Tudor
(74) *Attorney, Agent, or Firm*—Matthew J. Bussan, Esq.; James B. Bechtel, Esq.; Peter J. Van Bergen, Esq.

(57) ABSTRACT

The present invention controls the polar ejection angle of fragments in a fragmenting warhead. The warhead's detonators are initiated non-simultaneously to produce corresponding detonation waves in the warhead's explosive material. The detonation waves interact to control the polar ejection angle of fragments formed when the warhead's casing ruptures. Specified times of detonation for each of the detonators can be selected/adjusted after the warhead is deployed.

20 Claims, 3 Drawing Sheets

POLAR EJECTION ANGLE CONTROL FOR FRAGMENTING WARHEADS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to fragmenting warheads, and more particularly to the control of the polar ejection angle of fragments dispersed by a fragmenting warhead.

BACKGROUND OF THE INVENTION

Fragmenting warheads are used in a variety of military applications to deliver a distribution of high-velocity fragments to a target area. In terms of airborne warheads, FIG. 1 depicts the essential elements of an end initiated fragmenting warhead. Specifically, a fragmentable casing 10 having a longitudinal centerline axis 11 houses an explosive material 12. To detonate explosive material 12 and rupture casing 10 into fragments, an initiator or detonator 14 is placed in casing 10 at one end thereof. Upon initiation, a detonation wave commences at detonator 14 and propagates through explosive material 12 along the direction of the longitudinal axis 11 of casing 10. When the detonation wave reaches casing 101 a shock wave is transmitted to the casing which, in turn, causes casing 10 to expand. Expansion of casing 10 is further facilitated by the expanding detonation product gases. Casing 10 ruptures into fragments as such expansion continues. These fragments are ejected radially outward along "polar ejection angles" measured perpendicular to the external surface of casing 10 at the specific location of rupturing casing 10. The polar ejection angle $\alpha$ is governed by the detonation velocity ($V_D$) of explosive material 12 and the radial velocity ($V_F$) of the fragments. The polar ejection angle can be approximated by one-half of the Taylor angle whereby $$\alpha=\arcsin[V_F/(2V_D)].$$

This is depicted in FIG. 1 where dashed line 16 represents the perpendicular direction relative to the external surface of casing 102 at the point of a particular polar ejection angle measurement. For a typical warhead, the polar ejection angle for the end initiated fragmenting warhead just described is approximately 7 degrees. As is known in the art, variations in polar ejection angle occur near each end of the warhead due to the build-up of the detonation wave and discontinuities in end confinement of the explosive material.

The essential features of another type of airborne fragmenting warhead are illustrated in FIG. 2 where detonators 24 and 26 are located at the respective forward and aft ends of the warhead. Detonators 24 and 26 are initiated simultaneously. Upon initiation, detonation waves starting at detonators 24 and 26 propagate through explosive material 14 from either end of the warhead. In this example, the polar ejection angle for the vast majority of the fragments is approximately 0 degrees due to the meeting of the two detonation waves originating from each end.

Unfortunately, there are many instances where the fixed polar ejection angles of 0 degrees or 7 degrees (generated by the above-described fragmenting warheads) do not provide the needed flexibility for a particular mission. Further, since the polar ejection angles in these examples are fixed, the warhead's ability to adjust to a changing or moving target scenario is non-existent or at least severely limited.

SUMMARY OF THE INVENTION

Accordingly, it is an object of the present invention to provide for polar ejection angle control of a fragmenting warhead.

Another object of the present invention is to provide the means for adjusting the polar ejection angle of a fragmenting warhead to account for changing target scenarios.

Still another object of the present invention is to provide polar ejection angles for a fragmenting warhead that can range from negative 7 degrees to positive 7 degrees in a controllable fashion.

Other objects and advantages of the present invention will become more obvious hereinafter in the specification and drawings.

In accordance with the present invention, control of the polar ejection angle of fragments in a fragmenting warhead is provided. The warhead's casing is filled with explosive material and has at least two detonators spaced apart from one another and coupled to the explosive material. The detonators function in a non-simultaneous fashion to produce corresponding detonation waves in the explosive material. The detonation waves interact to control a polar ejection angle of fragments formed when the warhead's casing ruptures. The present invention includes provisions for selecting specified times of detonation for each of the detonators after the warhead is deployed.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
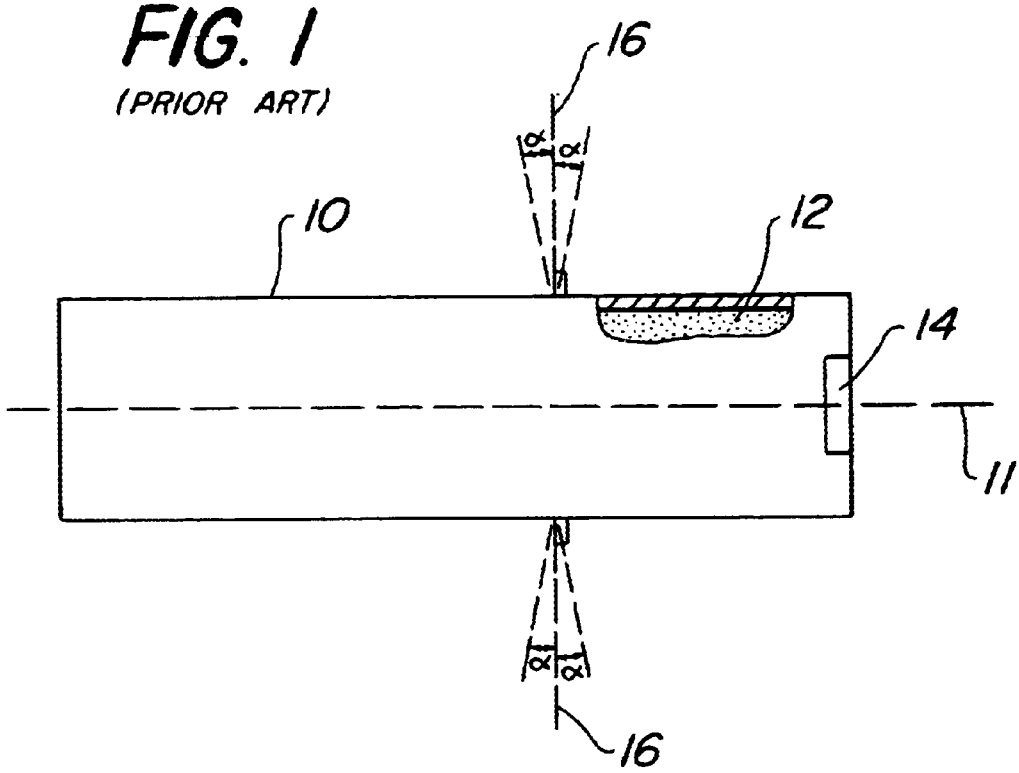
FIG. 1 (PRIOR ART)
FIG. 1 is a side schematic view of a prior art single-point, end initiated fragmenting warhead.
Figure 2:
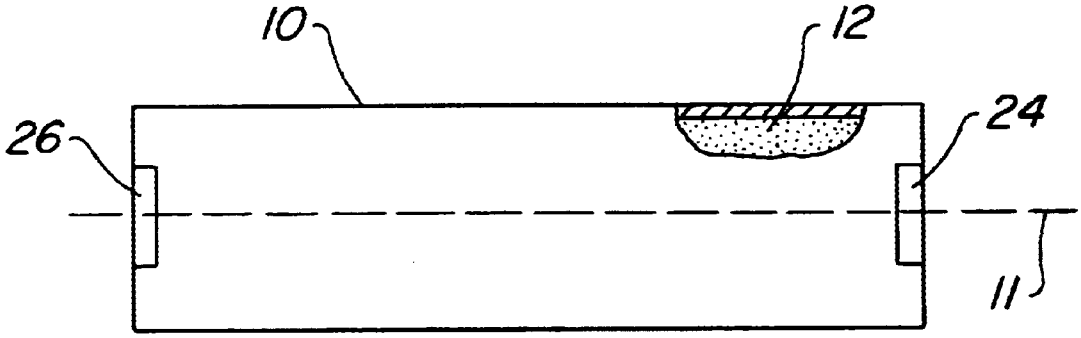
FIG. 2 (PRIOR ART)
FIG. 2 is a side schematic view of a prior art dual end initiated fragmenting warhead having forward and aft end detonators that are initiated simultaneously.
Figure 3:
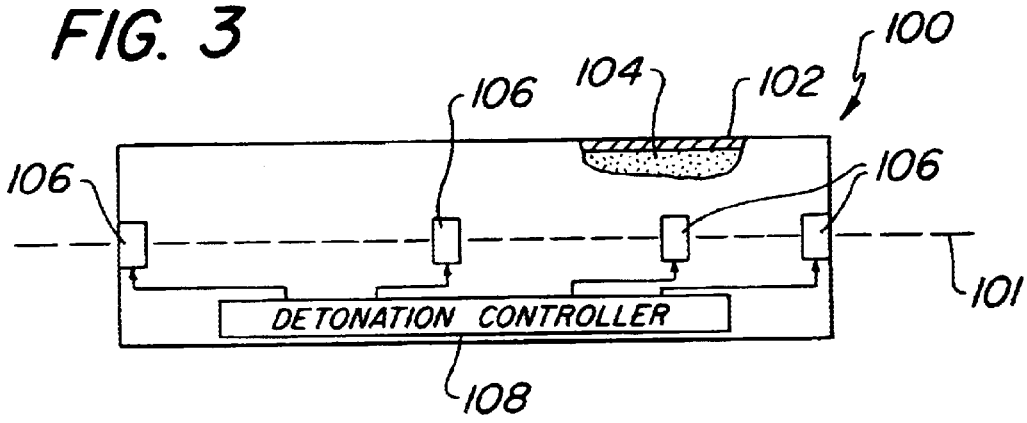
FIG. 3 is a side schematic view of one embodiment of a fragmenting warhead having polar ejection angle control in accordance with the present invention.

Referring again to the drawings, and more particularly to FIG. 3, the essential elements of a fragmenting warhead in accordance with the present invention are illustrated schematically and referenced generally by numeral 100. While various geometries for warhead 100 will be discussed further below, it is sufficient at this point in the discussion to ignore the geometry thereof except to say that a longitudinal axis 101 is defined thereby. Typically, warhead will travel in a direction along longitudinal axis 101.

The essential elements of warhead 100 include a fragmentable casing 102 that is constructed to fragment in a desired fashion as a result of interaction with the detonation wave and detonation products. The fragments (not shown) will fly away from warhead 100 at a polar ejection angle that is defined relative to directions perpendicular to the external surface of casing 102 at the points of fragmentation. The particular construction and fragmentation design of casing 102 is not a limitation of the present invention and will, therefore, not be discussed further herein.

Casing 102 is filled with an explosive material 104. Dispersed in explosive material 104 are a plurality of detonators 106. While the present invention requires the use of at least two detonators 106, warhead 100 will typically use more than two detonators 106 as illustrated. Detonators 106 can be centrally located in casing 102, but could also be distributed in other ways such as about the inner periphery of casing 102, surrounded by explosive material 104 but at positions distributed about longitudinal axis 101, etc. Furthermore, spacing between adjacent ones of detonators 106 can be even or uneven. Thus, it is to be understood that the particular placement of detonators 106 is not a limitation of the present invention.

Coupled to each of detonators 106 is a detonation controller 108 that issues detonation signals to bring about the initiation of detonators 106. Specifically, detonation controller 108 issues detonation signals to bring about the non-simultaneous detonation of detonators 106. It is the non-simultaneous detonation of detonators 106 that is used in the present invention to control the polar ejection angle of the fragments as will be described in further detail below.

Figure 4:
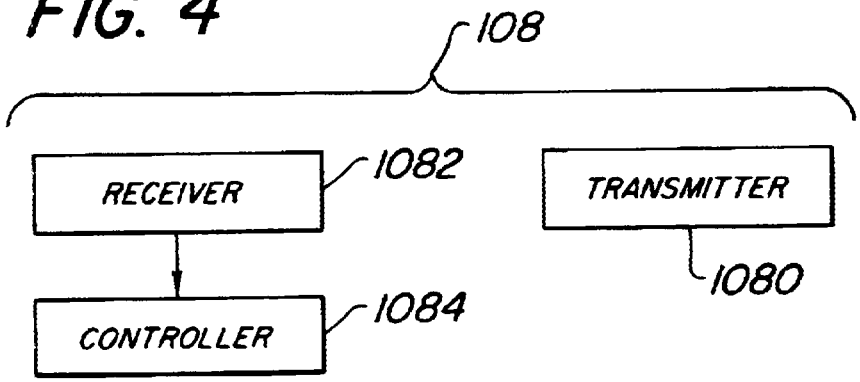
FIG. 4 is a schematic view of an embodiment of a detonation controller that can be used to select/adjust the detonation timing sequence used by the fragmenting warhead after the warhead has been deployed.

Detonation controller 108 can be pre-programmed with a specific timing sequence for the non-simultaneous detonation of detonators 106. However, to take greater advantage of the present invention, detonation controller 108 can be implemented in a way that allows the detonation timing sequence to be selected/adjusted after warhead 100 has been deployed, e.g., while warhead 100 is traveling towards a target area. Such an implementation of detonation controller 108 is illustrated schematically in FIG. 4 where a transmitter 1080 that is remotely located with respect to warhead 100 transmits the detonation timing sequence over the air waves. Located at warhead 100 are a receiver 1082 and a controller 1084. Receiver 1082 receives the transmitted detonation timing sequence and controller 1084 processes same for issuance to detonators 106. Transmitter 1080 could also be integrated into the weapon system and provide its timing data via hard wire or fiber optic communication with controller 1084.

Figure 5:
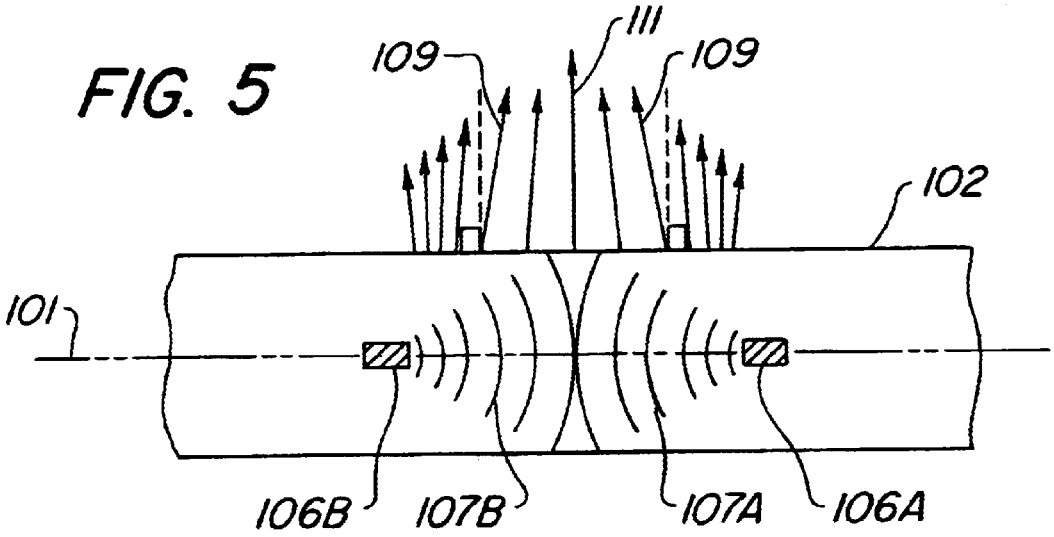
FIG. 5 is a schematic view of a portion of a fragmenting warhead illustrating the interaction between adjacent non-simultaneously occurring detonation waves for controlling the polar ejection angle in accordance with the present invention.

The operating principles of the present invention will now be explained with aid of FIG. 5 where the non-simultaneous initiation of two detonators 106A and 106B are used to control the polar ejection angle of fragments created once casing 102 ruptures. An initiation of detonator 106A causes a detonation wave 107A to develop and proceed toward detonator 106B. As the velocity of detonation wave 107A approaches its full velocity $V_D$, the polar ejection angle due solely to detonation wave 107A is approximately 7 degrees as illustrated by vector lines 109. However, in accordance with the present invention, detonator 106B is initiated at a specified time delay defined generally as being after initiation of detonator 106A but prior to the arrival of detonation wave 107A at detonator 106B. The corresponding generated detonation wave 107B proceeds towards detonation wave 107A. The collision or interaction of detonation waves 107A and 107B occurring between detonators 106A and 106B causes the polar ejection angle to be affected as illustrated by vector lines 111. A similar analysis can be applied for each additional detonator. Thus, by adjusting the time delay between detonation of detonators 106A and 106B, the average polar ejection angle can be controlled between negative 7 degrees and positive 7 degrees. In general, a longer time delay is used when larger polar ejection angles (e.g., between 4 and 7 degrees) are needed and a shorter time delay is used when smaller polar ejections (e.g., between 0 and 4 degrees) are needed. The time delays between each adjacent pair of detonators can be the same or can be different depending on the application. Note that as the number of points of initiation (i.e., detonators) increases, oscillations in the polar ejection angle are damped out.

In tests of the present invention, the preferred explosive material is a metal-accelerating explosive material because its performance is optimized for the acceleration of metal fragments. For any given explosive, the detonator spacing should be no less than twice the explosive's critical diameter. In the case of typical metal accelerating explosives, the critical diameter is on the order of 0.25–0.5 inches thereby leading to a minimum detonator spacing of approximately 0.5 inches. Conversely, the maximum separation distance between any two adjacent detonators is unlimited.

Figure 6:
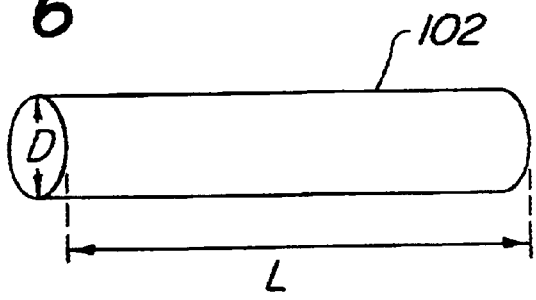
FIG. 6 is a schematic view of a cylindrical casing that can be used in the present invention.
Figure 7:
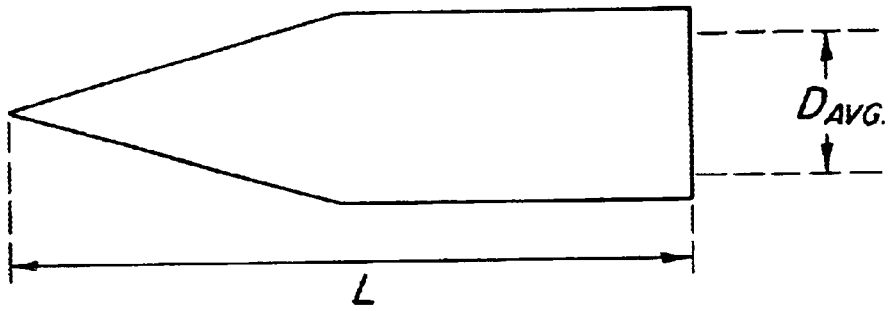
FIG. 7 is a schematic view of a conical casing that can be used in the present invention.
Figure 8:
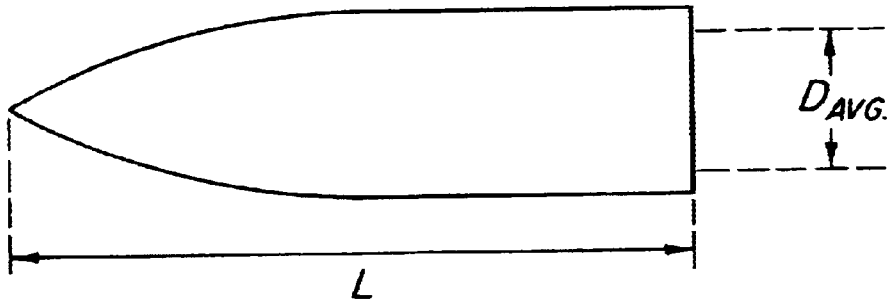
FIG. 8 is a schematic view of an ogival shaped casing that can be used in the present invention.
Figure 9:
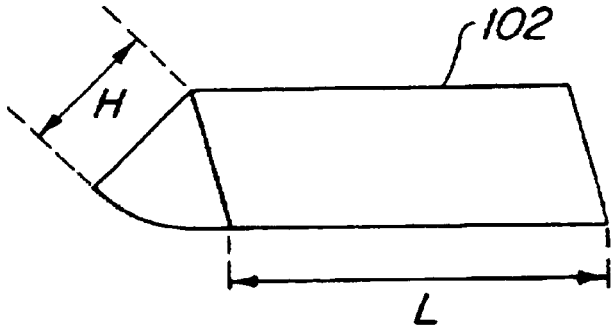
FIG. 9 is a schematic view of an elongated wedge shaped casing that can be used in the present invention.

As mentioned above, a variety of geometries for the warhead's casing can be used in the present invention. For example, casing 102 can be right circular cylinder as illustrated in FIG. 6 with a length-to-diameter (L/D) ratio in the approximate range of 1–9. Casing 102 could also be tapered along its length in a conical (FIG. 7) or ogival (FIG. 8) fashion. For both the conical and ogival shaped casings, a length-to-average diameter ($L/D_{AVG}$) ratio in the approximate range of 1–15 should be maintained. Still further, casing 102 could be embodied by an elongated wedge shape as illustrated in FIG. 9 where a length-to-height (L/H) ratio in the approximate range of 1–10 should be maintained.

The advantages of the present invention are numerous. The polar ejection angle of a fragmenting warhead can be optimized for a particular application. The adjustment can be made prior to or after deployment of the warhead. Thus the present invention will allow for the design of a single fragmenting warhead construction for multiple and changing tactical scenarios.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed is:

1. A method of controlling the polar ejection angle of fragments in a fragmenting warhead, comprising the steps of:

providing a casing filled with a continuum of explosive material with at least two detonators spaced apart from one another and coupled to said explosive material; and actively detonating said at least two detonators non-simultaneously to produce corresponding detonation waves in said continuum of explosive material that interact to control a polar ejection angle of fragments formed when said casting ruptures.

2. A method according to claim 1 further comprising the step of selecting specified times of detonation for each of said at least two detonators after said fragmenting warhead is deployed.

3. A method of controlling the polar ejection angle of fragments in a fragmenting warhead, comprising the steps of:

providing a casing filled with a continuum of explosive material with a plurality of detonators therein wherein a minimum spacing between any two of said plurality of detonators is approximately 0.5 inches; and actively detonating said plurality of detonators non-simultaneously to produce corresponding detonation waves in said continuum of explosive material that interact to control a polar ejection angle of fragments formed when said casing ruptures.

4. A method according to claim 3 further comprising the step of selecting specified times of detonation for each of said plurality of detonators after said fragmenting warhead is deployed.

5. A fragmenting warhead, comprising:

a casing;

a continuum of explosive material filling said casing;

at least two detonators spaced apart from one another and coupled to said explosive material; and means for actively detonating said at least two detonators non-simultaneously at specified times, wherein said at least two detonators initiate corresponding detonation waves in said continuum of explosive material that interact to control a polar ejection angle of fragments formed when said casing ruptures.

6. A fragmenting warhead as in claim 5 wherein said casing is a circular cylinder having a length-to-diameter ratio that is between approximately 1 and 9.

7. A fragmenting warhead as in claim 5 wherein said casing tapers along its length and has a length-to-average diameter ratio that is between approximately 1 and 15.

8. A fragmenting warhead as in claim 5 wherein said casing is ogival along its length and has a length-to-average diameter ratio that is between approximately 1 and 15.

9. A fragmenting warhead as in claim 5 wherein said casing is an elongated wedge having a length-to-height ratio that is between approximately 1 and 10.

10. A fragmenting warhead as in claim 5 wherein said at least two detonators are evenly spaced throughout said continuum of explosive material.

11. A fragmenting warhead as in claim 5 wherein said at least two detonators are unevenly spaced throughout said continuum of explosive material.

12. A fragmenting warhead as in claim 5 wherein said means for detonating includes means for adjusting said specified times after deployment of said fragmenting warhead.

13. A fragmenting warhead, comprising:

a casing;

a continuum of explosive material filling said casing;

at least two detonators spaced apart from one another in said continuum of explosive material wherein a minimum spacing between any two of said at least two detonators is approximately 0.5 inches; and means for actively detonating said at least two detonators non-simultaneously at specified times, wherein said at least two detonators initiate corresponding detonation waves in said continuum of explosive material that interact to control a polar ejection angle of fragments formed when said casing ruptures.

14. A fragmenting warhead as in claim 13 wherein said casing is a circular cylinder having a length-to-diameter ratio that is between approximately 1 and 9.

15. A fragmenting warhead as in claim 13 wherein said casing tapers along its length and has a length-to-average diameter ratio that is between approximately 1 and 15.

16. A fragmenting warhead as in claim 13 wherein said casing is ogival along its length and has a length-to-average diameter ratio that is between approximately 1 and 15.

17. A fragmenting warhead as in claim 13 wherein said casing is an elongated wedge having a length-to-height ratio that is between approximately 1 and 10.

18. A fragmenting warhead as in claim 13 wherein said at least two detonators are evenly spaced throughout said continuum of explosive material.

19. A fragmenting warhead as in claim 13 wherein said at least two detonators are unevenly spaced throughout said continuum of explosive material.

20. A fragmenting warhead as in claim 13 wherein said means for detonating includes means for adjusting said specified times after deployment of said fragmenting warhead.

* * * * *